US007544892B2

(12) United States Patent
Susai et al.

(10) Patent No.: US 7,544,892 B2
(45) Date of Patent: Jun. 9, 2009

(54) CRIMP CONTACT FOR AN ALUMINUM STRANDED WIRE, AND CABLE END STRUCTURE OF AN ALUMINUM STRANDED WIRE HAVING THE CRIMP CONTACT CONNECTED THERETO

(75) Inventors: Kyota Susai, Tokyo (JP); Toshiyuki Hashimoto, Tokyo (JP)

(73) Assignee: The Furukawa Electric Co., Ltd., Tokyo (JP)

( * ) Notice: Subject to any disclaimer, the term of this patent is extended or adjusted under 35 U.S.C. 154(b) by 0 days.

(21) Appl. No.: 12/153,862

(22) Filed: May 27, 2008

(65) Prior Publication Data

US 2008/0230269 A1 Sep. 25, 2008

(51) Int. Cl.
*H01R 4/00* (2006.01)

(52) U.S. Cl. ..... 174/84 R; 174/84 C

(58) Field of Classification Search ..... 174/36, 174/74 R, 82, 83, 84 R, 84 C; 439/877–882, 439/421

See application file for complete search history.

(56) References Cited

U.S. PATENT DOCUMENTS

| | | | | |
|---|---|---|---|---|
| 3,510,829 | A * | 5/1970 | Keller | 439/421 |
| 3,812,448 | A * | 5/1974 | Haitmanek | 439/421 |
| 4,142,771 | A * | 3/1979 | Barnes et al. | 439/442 |
| 5,322,575 | A | 6/1994 | Endo et al. | |
| 7,210,958 | B1 * | 5/2007 | Jacques et al. | 439/421 |
| 2003/0013353 | A1 * | 1/2003 | Sakaguchi et al. | 439/877 |
| 2004/0157504 | A1 | 8/2004 | Fujimoto et al. | |
| 2005/0026515 | A1 * | 2/2005 | Hashimoto et al. | 439/877 |
| 2005/0227549 | A1 | 10/2005 | Takayama | |

FOREIGN PATENT DOCUMENTS

| | | | |
|---|---|---|---|
| JP | 62-36213 | Y2 | 9/1987 |
| JP | 4-236736 | A | 8/1992 |
| JP | 8-50823 | A | 2/1996 |
| JP | 8-321330 | A | 12/1996 |
| JP | 8-321331 | A | 12/1996 |
| JP | 8-321332 | A | 12/1996 |
| JP | 11-135226 | A | 5/1999 |
| JP | 2003-031274 | A | 1/2003 |
| JP | 2003-243057 | A | 8/2003 |
| JP | 2003-243058 | A | 8/2003 |
| JP | 2003-249284 | A | 9/2003 |
| JP | 2004-193073 | A | 7/2004 |
| JP | 2004-292875 | A | 10/2004 |
| JP | 2005-174896 | A | 6/2005 |
| JP | 2005-302475 | A | 10/2005 |
| JP | 2005-307334 | A | 11/2005 |

* cited by examiner

*Primary Examiner*—William H Mayo, III
(74) *Attorney, Agent, or Firm*—Birch, Stewart, Kolasch & Birch, LLP

(57) ABSTRACT

The present invention is directed to a crimp contact for an aluminum stranded wire having a serration provided in an inner face of a crimping portion of the crimp contact, wherein a ratio d/e is 0.33 or more, in which d represents a depth of a groove constituting the serration and e represents a diameter of an aluminum wire constituting the aluminum stranded wire. The number of grooves in the crimp contact is 3 or more. The present invention is also directed to a cable end structure of an aluminum stranded wire, wherein a ratio between a sectional area of the aluminum stranded wire after crimping and a sectional area thereof before crimping is from 0.7 to 0.95.

3 Claims, 3 Drawing Sheets

CRIMP CONTACT FOR AN ALUMINUM STRANDED WIRE, AND CABLE END STRUCTURE OF AN ALUMINUM STRANDED WIRE HAVING THE CRIMP CONTACT CONNECTED THERETO

This non-provisional application claims priority under 35 U.S.C. § 119(a) on Patent Application No. 2005-338604 filed in Japan on Nov. 24, 2005, and Patent Application No. 2006-293215 filed in Japan on Oct. 27, 2006, and claims priority under 35 U.S.C. § 120 based on PCT/JP2006/323232, filed on Nov. 21, 2006, each of which is entirely herein incorporated by reference.

TECHNICAL FIELD

The present invention relates to a crimp contact favorable for electric connection of automobile wire harnesses, battery cables, or the like, using an aluminum stranded wire, and to a cable end structure of an aluminum stranded wire excellent in electric connectivity, using the crimp contact.

BACKGROUND ART

Aluminum stranded wires, which have electric conductor wires composed of an aluminum-based material, are used as a cable. In order that such cables are connected to various electric instruments or are connected to each other, a connection terminal is equipped at both ends of aluminum stranded wire. As the connection contact, a contact of a crimp contact-type is used.

As illustrated in FIG. 5, the crimp contact has a crimping portion 10 of a U-shaped cross-section and a bolt-fastening portion 13, and a serration 12 is provided in the inner face of the crimping portion 10, the serration 12 being formed of a plurality of concave grooves 11 for preventing the aluminum stranded wire from coming out. A hole 14, in which a bolt or the like will be pierced, is formed in the fastening portion 13.

An aluminum stranded wire (not illustrated) made naked by stripping a sheath of an aluminum cable terminal is inserted into the crimping portion 10, and side walls 15 of the crimping portion 10 are pressed from the outside, so as to crimp the portion and the wire to each other. Aluminum wires which constitute the aluminum stranded wire are fitted into the grooves 11 of the serration 12 by the crimping, so as to be prevented from coming out. Additionally, an oxide film of the aluminum wires, which constitute the aluminum stranded wire, is broken so that the metal which is inside the oxide film has exposed. Thus, good electric connection is attained.

Various improvements in connectivity between the aluminum stranded wire and the crimp contact have been proposed.

Examples thereof include: a structure in which powder of a metal, which is softer than the aluminum stranded wire, is dispersed in an inner face of a crimping portion to coagulate (adhere) the crimping portion inner face with the aluminum stranded wire; a structure in which a powder, which is harder than the aluminum stranded wire, is dispersed to break an oxide film on the surface of aluminum wires; a structure in which powders of the above softer one and harder one are dispersed; a structure in which fitting depths of serrations (grooves) are made different from each other; a structure in which a serration (groove) is formed into a spiral form; and a structure in which protrusions are formed on the inner face of a crimping portion.

However, the structures in which metal powder is dispersed or adhered have such a problem that costs and labors are required, and the above-mentioned groove structure and protrusion-formed serration form have such a problem that aging deterioration in contact resistance cannot be sufficiently prevented.

DISCLOSURE OF INVENTION

The present invention is contemplated for providing a crimp contact for an aluminum stranded wire, which makes it possible to prevent aging deterioration in electric connectivity, and for providing a cable end structure of an aluminum stranded wire to which the crimp contact is crimped, the structure being excellent in electric connectivity and mechanical connectivity, each of which can be attained without costs and labors.

According to the present invention, there is provided the following means:

(1) A crimp contact for an aluminum stranded wire having a serration provided in an inner face of a crimping portion of the crimp contact, wherein a ratio d/e is 0.33 or more, in which d represents a depth of a groove constituting the serration and e represents a diameter of an aluminum wire constituting the aluminum stranded wire, and wherein the number of grooves is 3 or more;

(2) The crimp contact for an aluminum stranded wire according to item (1), wherein the crimping portion is composed of copper or a copper alloy, and wherein a stress relaxation ratio of the crimping portion is 70% or less;

(3) The crimp contact for an aluminum stranded wire according to item (1) or (2), which is composed of brass having a crystal grain size of 50 μm or less;

(4) The crimp contact for an aluminum stranded wire according to any one of items (1) to (3), which has an electrical conductivity of 25% IACS or more;

(5) The crimp contact for an aluminum stranded wire according to any one of items (1) to (4), which has a tensile strength of 400 MPa or more, and a Vickers hardness of 90 $N/mm^2$ or more;

(6) The crimp contact for an aluminum stranded wire according to any one of items (1) to (5), which has the tensile strength twice or more bigger than a tensile strength of the elemental wires which constitute the aluminum stranded wire, and has the Vickers hardness twice or more bigger than a hardness of the elemental wires which constitute the aluminum stranded wire;

(7) The crimp contact for an aluminum stranded wire according to any one of items (1) to (6), which has a surface to which a tin (Sn) plating or solder plating is applied so as to have a thickness of 1 μm or more and 20 μm or less;

(8) The crimp contact for an aluminum stranded wire according to item (7), wherein the Sn plating has a pure Sn layer having a thickness of 0.2 μm or more;

(9) The crimp contact for an aluminum stranded wire according to item (7) or (8), to which a copper (Cu) plating or a nickel (Ni) plating is applied as an underlying plating for the Sn plating or the solder plating;

(10) The crimp contact for an aluminum stranded wire according to any one of items (7) to (9), to which a Cu plating is applied as an underlying plating for the Sn plating, and a Ni plating is applied as an underlying plating for the Cu plating;

(11) A cable end structure of an aluminum stranded wire to which the crimp contact for an aluminum stranded wire according to any one of items (1) to (10) is crimped, wherein a ratio p/q is from 0.7 to 0.95, in which p represents a sectional area of the aluminum stranded wire after the crimping and q represents a sectional area of the aluminum stranded wire before the crimping; and

(12) The cable end structure of an aluminum stranded wire according to item (11), wherein a thickness of an oxide film of the aluminum wires which constitute the aluminum stranded wire is 20 nm or less.

Other and further features and advantages of the invention will appear more fully from the following description, appropriately referring to the accompanying drawings.

BEST MODE FOR CARRYING OUT THE INVENTION

With reference to the drawings, preferred embodiments of the crimp contact of the present invention for an aluminum stranded wire will be specifically described hereinafter.

Figure 1:
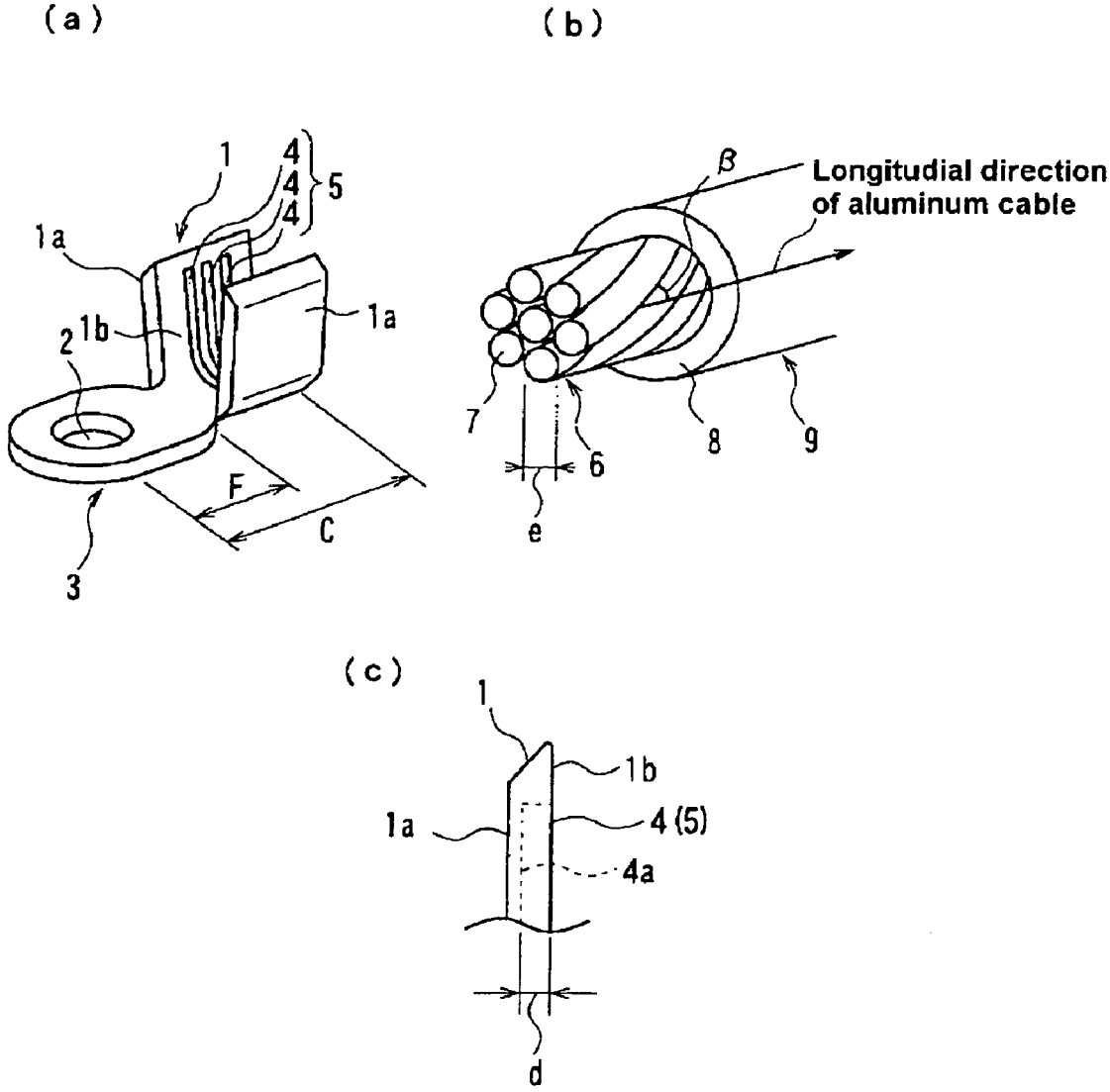
FIGS. 1(*a*) to 1(*c*) are explanatory views illustrating an embodiment of the crimp contact of the present invention for an aluminum stranded wire, and FIG. 1(*a*) is a perspective view of the crimp contact, FIG. 1(*b*) is a perspective view of an aluminum cable having a cable end being stripped the sheath, and FIG. 1(*c*) is an explanatory view of grooves of a serration.

As illustrated in FIG. 1(*a*), a crimp contact of the present invention has a crimping portion 1 having a U-shaped cross-section (open barrel type), and a fastening portion 3 in which a bolt hole 2 is provided. A serration 5 including three parallel grooves 4 is formed in an inner face of the crimping portion 1. As illustrated in FIG. 1(*b*), for example, a sheath 8 of an cable end (being stripped insulation layer) of an aluminum cable 9 is removed, the thus-naked aluminum stranded wire 6 is inserted into the crimping portion 1, and side walls 1*a* of the crimping portion 1 are pressed from the outside, so as to make a terminal structure of the aluminum stranded wire.

In FIG. 1(*a*), C represents a distance from the center of the bolt hole 2 to the rear end of the crimping portion 1, F represents a distance from the center of the bolt hole to the front end of the crimping portion 1, and (C-F) represents a length of the crimping portion 1.

In the present invention, the ratio (d/e) between the depth d (see FIG. 1(*c*)) of the grooves 4 and the diameter e (see FIG. 1(*b*)) of the aluminum wires 7 which constitute the aluminum stranded wire 6, is set to 0.33 or more, and the number of grooves is set to 3 or more.

In the present invention, the reason why the ratio (d/e) between the depth d of the grooves 4 of the serration 5 and the diameter e of the aluminum wires 7 which constitute the aluminum stranded wire 6, is set to 0.33 or more, and the number of grooves 4 is set to 3 or more, is that if the ratio (d/e) is less than 0.33 or if the number of grooves 4 of the serration 5 is less than 3, good electric connectivity and low contact resistance cannot be stably attained.

The number of grooves 4 of the serration 5 is preferably 5 or more, and the upper limit thereof is preferably 10. If it is too large, it is a possibility that a problem is caused in precision of the working and abrasion of stamping dies. The ratio (d/e) is preferably 0.5 or more, and the upper limit thereof is preferably 10. If it is too large, the oxide film is insufficiently broken so that a worry may be caused in the initial contact resistance or instable contact resistance during thermal shock testing. The depth of the grooves 4 of the serration 5 means the distance d from the inner face 1*b* of the crimping portion 1 to bottom faces 4*a* of the grooves 4 (see FIG. 1(*c*)).

In the present invention, the longitudinal direction of the grooves of the serration in the inner face of the crimping portion is generally made perpendicular to the longitudinal direction of the aluminum cable 9. That direction may be changed, according to the stranded angle b (see FIG. 1(*b*)) of the aluminum stranded wire to the longitudinal direction of the aluminum cable (the arrow in FIG. 1(*b*)), whereby the connection strength and the like can be enhanced.

Figure 2:
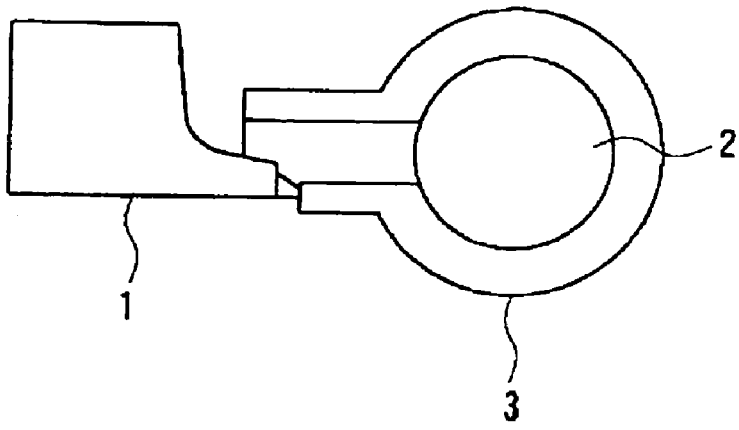
FIG. 2 is a front view illustrating another embodiment of the crimp contact of the present invention for an aluminum stranded wire.

The crimp contact illustrated in FIG. 2 is a crimp contact to be fastened to a battery terminal. The diameter of a hole 2 in a fastening portion 3 is slightly larger than the diameter of the battery terminal. In this crimp contact, the opening direction of a crimping portion 1 is perpendicular to the direction along which the hole 2 is made in the fastening portion 3. In the crimp contact illustrated in FIG. 1(*a*), those two directions are parallel to each other.

The crimp contact of the present invention can be formed from a sheet made of an electrically conductive metal, such as copper, a copper alloy, aluminum, or an aluminum alloy, and is preferably made of copper or a copper alloy, which is excellent in electrical conductivity and mechanical strength. The stress relaxation ratio of the crimping portion is preferably 70% or less, in order to prevent an increase in the electric resistance between the crimping portion and the aluminum stranded wire in cooling-and-heating cycle testing when using.

In particular, in the case of using brass having a crystal grain size of 50 μm or less as the material of the crimp contact, the connection strength between the crimp contact and the aluminum stranded wire becomes high, which is preferable. The crystal grain size is more preferably 30 μm or less, even more preferably 20 μm or less.

The crimp contact can be produced by integrally forming the sheet made of an electrically conductive metal. The crimp contact may also be produced by cutting an electrically conductive metal block.

The electrical conductivity of this crimp contact is preferably 25% IACS or more, from the viewpoint of electrical conductivity.

Further, it is preferred that the tensile strength of the crimp contact is 400 MPa or more and the Vickers hardness thereof is 90 $N/mm^2$ or more, since the connection strength between the crimp contact and the aluminum stranded wire becomes high. It is preferred that the tensile strength of the crimping portion is twice or more bigger than the tensile strength of the elemental wires of the aluminum stranded wire and the hardness thereof is twice or more bigger than the hardness of the elemental wires of the aluminum stranded wire since metal aluminum appears easily as a result of oxide layer breakage during crimping the stranded wire, so that the electric resistance between the contact and the aluminum wires of the stranded wire becomes stably low.

In the present invention, it is preferred that the tin plating or tin alloy solder plating is applied at least to the surface of the serration portion in the crimp contact. The thickness thereof is preferably 1 μm or more. The application of the tin plating or solder plating makes the adhesiveness between the contact and the aluminum wires high when the stranded wire is crimped, so that the electric resistance becomes stably low. If the thickness is too large, the aluminum wires are less-fitted into the serration at the time of the crimping. Thus, the thickness is preferably 20 μm or less. Furthermore, in order to prevent an increase in the electric resistance between the crimping portion and the aluminum stranded wire in cooling-and-heating cycles when using, it is preferred that the Cu plating or Ni plating is applied as the underlying plating for the Sn plating or solder plating, and further these are alternately plated layer by layer so as to be each made in one or more layers. In the case of the Sn plating, the thickness of a pure Sn layer is preferably set to 0.2 μm or more, to keep corrosion resistance.

In another embodiment of the present invention, it is preferable that the Cu plating is applied as the underlying plating for the Sn plating applied to the surface of the crimp contact for an aluminum stranded wire, and further the Ni plating is applied as the underlying plating for the copper layer.

The following will describe the cable end structure, of the present invention, of an aluminum stranded wire.

Figure 3:
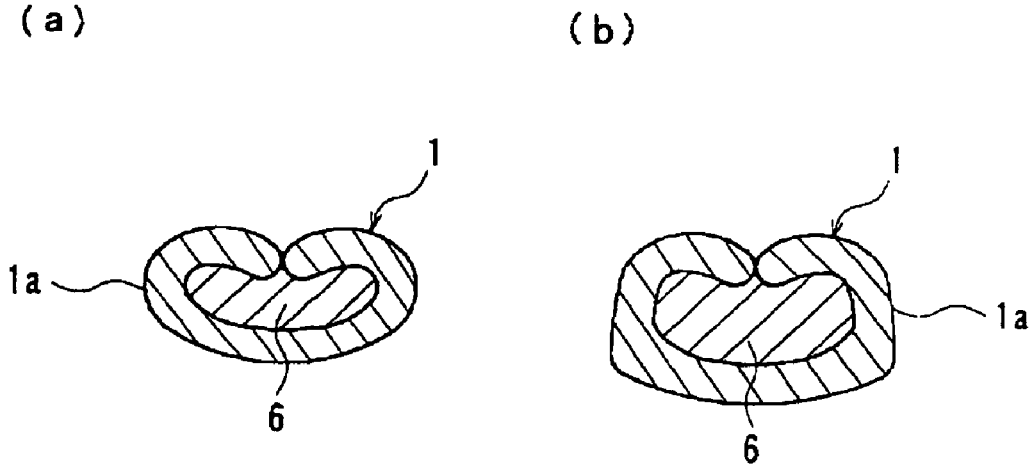
FIG. 3(*a*) and FIG. 3(*b*) are each a sectional view illustrating an embodiment of the cable end structure of the present invention of an aluminum stranded wire, and FIG. 3(*a*) illustrates a structure in which the ratio between sectional areas is 0.7, and FIG. 3(*b*) illustrates a structure in which the ratio between sectional areas is 0.95.

The cable end structure is a structure obtained by inserting the aluminum stranded wire 6 made naked by removing the sheath 8 of the end of the aluminum cable 9 illustrated in FIG. 1(*b*), into the crimping portion 1 of the crimp contact illustrated in FIG. 1(*a*), and then pressing the side walls 1*a* of the crimping portion 1 from the outside to crimp the aluminum stranded wire 6 to the crimping portion 1. FIG. 3(*a*) and FIG. 3(*b*) each illustrate a cross section of the cable end structure. FIG. 3(*a*) illustrates the case where the ratio (p/q) between the sectional areas before and after the crimping of the aluminum stranded wire 6 is 0.7, and FIG. 3(*b*) illustrates the case where the ratio (p/q) between the sectional areas before and after the crimping of the aluminum stranded wire 6 is 0.95, in which p is the sectional area of the aluminum stranded wire after the crimping thereof, and q is the sectional area thereof before the crimping.

Figure 4:
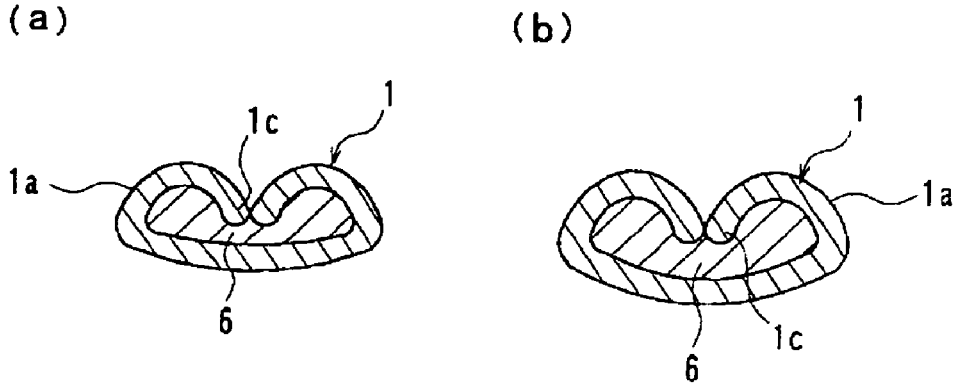
FIG. 4(*a*) and FIG. 4(*b*) are each a sectional view illustrating another embodiment of the cable end structure of the present invention of an aluminum stranded wire, and FIG. 4(*a*) illustrates a structure in which the ratio between sectional areas is 0.7, and FIG. 4(*b*) illustrates a structure in which the ratio between sectional areas is 0.95.
Figure 5:
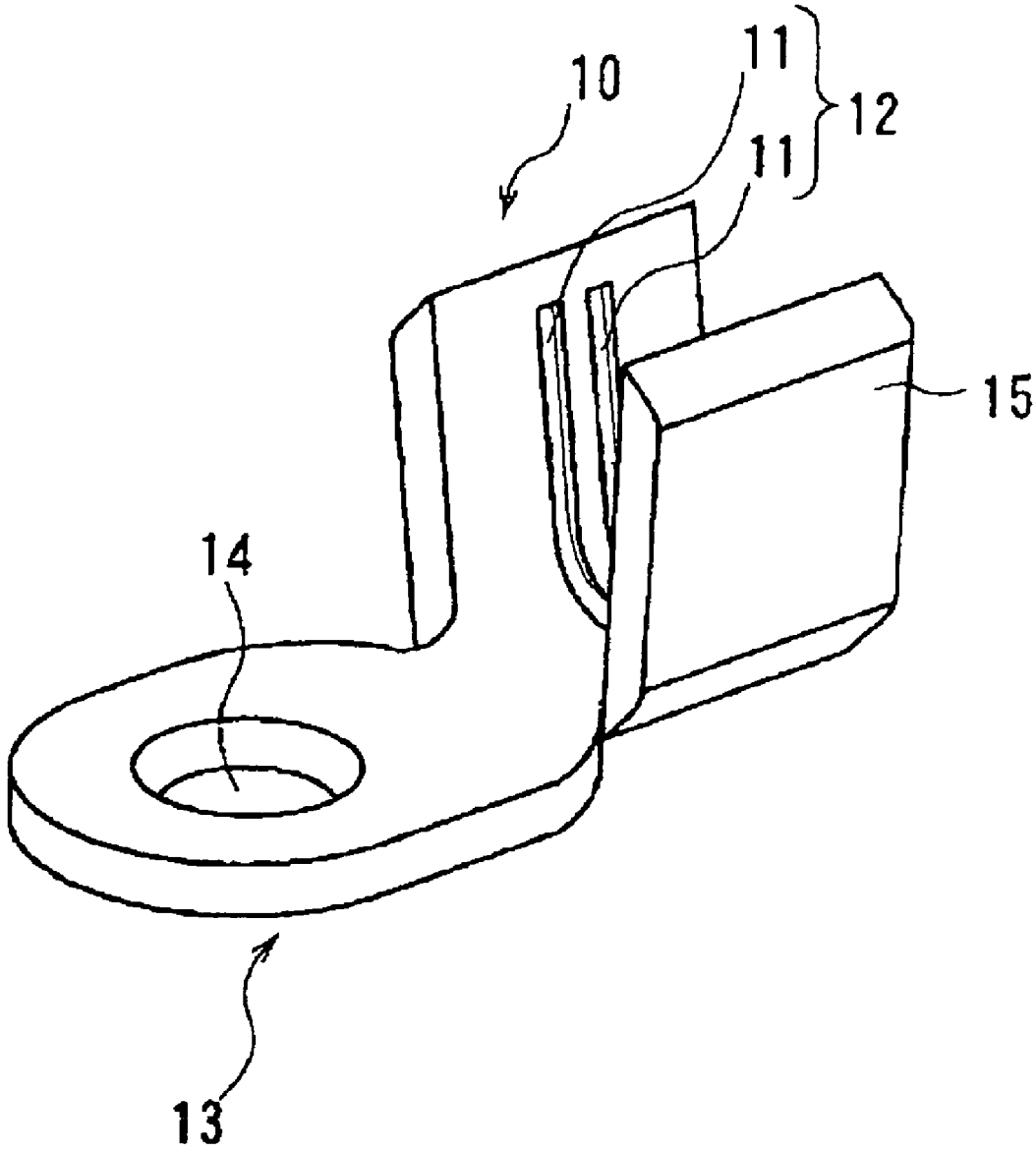
FIG. 5 is a perspective view of a conventional crimp contact for an aluminum stranded wire.

Cable end structures illustrated in FIG. 4(*a*) and FIG. 4(*b*) are each a structure in which front tip ends 1*c* of side walls of a crimping portion 1 are embedded in the aluminum stranded wire 6 to increase the contact area between the aluminum stranded wire 6 and the crimping portion 1, and further an oxide film of the aluminum stranded wire 6 (aluminum wires 7) is broken in the side wall front tip ends 1*c* to improve the electric connectivity. FIG. 4(*a*) illustrates a structure in which the ratio between the sectional areas is 0.7, and FIG. 4(*b*) illustrates a structure in which the ratio between the sectional areas is 0.95.

In the present invention, the reason why the ratio (p/q) between the sectional area p of the aluminum stranded wire after crimping and the sectional area q thereof before the crimping is specified into the range of 0.7 to 0.95 is that: if the ratio p/q is too small, the stranded wire (elemental wires) is broken away or becomes too thin, not to give a sufficient connection strength between the crimp contact and the stranded wire, and the stranded wire undergoes work-hardening so that stress relaxation during cooling-and-heating cycles when using becomes large to increase the contact resistance; on the other hand, if the ratio p/q is too large, the crimping power becomes so weak that the oxide film of the aluminum stranded wire is not sufficiently broken, whereby the initial contact resistance may increase, or so that the stranded wire may come out.

It is preferred to have the thickness of the oxide film on the surface of the aluminum wires 7, which constitute the aluminum stranded wire, to 20 nm or less; since the connection strength between the crimp contact and the stranded wire can be made high within a compression ratio range from 0.7 to 0.95.

Examples of the crimp contact of the present invention include crimp contacts each composed of a single crimping portion 1 and a single fastening portion 3, as illustrated in FIG. 1(*a*) and FIG. 2, and crimp contacts for relaying, and crimp contacts for branching that are each composed of a plurality of crimping portions. Even if a single aluminum wire other than the stranded aluminum wire is used, the crimp contact of the present invention exhibits the same advantageous effects as in the case of using the aluminum stranded wire.

At ends of an aluminum stranded wire, to which the crimp contact of the present invention for an aluminum stranded wire is crimped, in order to prevent corrosion between different metals or prevent corrosion of gaps between the aluminum stranded wire, a waterproof tube or waterproof mold is preferably applied to the outside of the wire, not to cause water to remain in a connection portion between the aluminum stranded wire and the contact, or the gaps between elemental wires of the aluminum stranded wire.

The present invention is not limited to the above-mentioned embodiments, and any variation thereof may be carried out as long as the variation does not depart from the subject matter of the present invention.

The crimp contact of the present invention is a contact in which the depth of grooves of a serration in an inner face of a crimping portion is specified according to the diameter of aluminum wires which constitute aluminum stranded wire to be crimped. Therefore, at the time of crimping the stranded wire, an oxide film on the surface of the aluminum wires is sufficiently broken by the grooves, to favorable good electric connectivity. Further, the aluminum stranded wire can be prevented from coming out from the crimping portion, so that the mechanical connectivity is also excellent. The electric connectivity can be further enhanced, by making the crimping portion of copper or a copper alloy, setting the stress relaxation ratio of the crimping portion into a specific range, and/or applying plating thereto. Additionally, the present invention in which the tensile strength and/or the Vickers hardness of the crimp contact are specified, exhibits a further-enhanced favorable electric connectivity.

In the cable end structure of an aluminum stranded wire, according to the present invention, since the ratio (p/q) between the sectional area p of the aluminum stranded wire after the crimping thereof and the sectional area q before the crimping is set into a specific range, favorable electric connectivity can be obtained. Further, the aluminum stranded wire is less damaged, and a sufficient connection strength can be given.

The present invention will be described in more detail based on examples given below, but the invention is not meant to be limited by these.

EXAMPLES

Example 1

Crimp contacts having a shape illustrated in FIG. 1(*a*) were each formed by pressing a Cu-30 mass % Zn alloy strip (O-material) 2.0 mm in thickness. Into a crimping portion 1 thereof, was inserted an aluminum stranded wire 6 made naked by removing a sheath 8 of an end of aluminum cable 9 as illustrated in FIG. 1(*b*). Then, two side walls 1*a* of the crimping portion 1 were pressed from the outside to crimp the aluminum stranded wire 6, thereby forming a cable end structure of the aluminum stranded wire. The length of the crimping portion 1, (C-F) in FIG. 1(*a*), was 13 mm.

The aluminum stranded wire 6 to be used was a stranded wire having a sectional area of 25 $mm^2$ and made by stranding Al-0.1 mass % Mg-0.2 mass % Cu alloy elemental wires, which each had a diameter of 0.32 mm and were annealed at 350° C. for 2 hours, into a rope lay strand (19 groups/17 elemental wires) (i.e. a stranded wire obtained by: gathering 17 alloy elemental wires into each group; stranding each of the groups into a strand, and then standing the resultant strands, the number of which was 19, concentrically with each other). As shown in Table 1, for the individual sample, the following were variously changed: the number of grooves 4 in the inner face 1*b* of the crimping portion 1; the ratio (d/e) between the depth d of the grooves 4 and the diameter e of the aluminum wires 7; and the ratio (p/q) between the sectional areas before and after the crimping of the aluminum stranded wire 6.

With respect to the resultant cable end structures of aluminum stranded wires, the connection strength (pulling-out load) between the aluminum stranded wire and the crimping portion, and the electric resistance were examined.

As for the connection strength of each of the crimp contacts, the fastening portion and the aluminum cable were grasped to conduct a tensile test, and the load when the aluminum stranded wire came out from the crimping portion was determined. Crimp contacts in which the load was 1.7 kN or more were judged to be good in mechanical connectivity.

The electric resistance of each of the cable end structures of the aluminum stranded wire was measured before and after a thermal impact test (cold-and-hot impact test). The following cable end structures were judged to be good in electric connectivity: structures in which the electric resistance r of the crimping portion before the test (initial stage) was 1.0 mΩ or less, the electric resistance s after the test (final stage) was 1.5 mΩ or less, and the ratio (s/r) between the electric resistances before and after the test was 10 or less. The thermal impact test was conducted by repeating a low-temperature environment of −40° C. and a high-temperature environment of +120° C. alternately to the crimping portion 1,000 times.

The electric resistance was measured by a four-probe method. A current was caused to flow at 0.1 mA or more. The power source device to be used was a device having precision of a voltage of 0.1 V or less and a current of 0.01 A or less. The voltmeter to be used was a voltmeter having precision of 0.01 mV or less.

The stress relaxation ratio of the crimping portion was measured under conditions that the surface maximum stress was 500 $N/mm^2$, the temperature was 120° C., and the time period was 100 hours, which are prescribed in Japan Copper and Brass Association (JCBA) T312:2001.

The stress relaxation ratio of the crimping portions of the crimp contacts was 50%.

The results of these tests and measurements are shown in Table 1.

Example 2

A cable end structure of an aluminum stranded wire was formed in the same manner as in Example 1, except that the crimp contact was formed by using a Cu-30 mass % Zn alloy strip (H-material) with thickness 2.3 mm. The same tests and measurements as in Example 1 were then conducted. The results are shown in Table 1.

Example 3

A cable end structure of an aluminum stranded wire was formed in the same manner as in Example 1, except that the crimp contact was formed by using a C5210 alloy strip (H-material) with thickness 1.7 mm. The same tests and measurements as in Example 1 were then conducted. The results are shown in Table 1.

Example 4

A cable end structure of an aluminum stranded wire was formed in the same manner as in Example 1, except that the crimp contact was formed by using a C1020 copper alloy strip (H-material) with thickness 2.0 mm and that the stress relaxation ratio of the crimping portion was set to a value outside the value range as specified in the above-mentioned item (2). The same tests and measurements as in Example 1 were then conducted. The results are shown in Table 1.

Example 5

Cable end structures of aluminum stranded wires were formed in the same manner as in Example 1, except that the ratio (p/q) between the sectional areas of the aluminum stranded wire before and after the crimping thereof was set to a value outside the value range as specified in the above-mentioned item (11). The same tests and measurements as in Example 1 were then conducted. The results are shown in Table 1.

Comparative Example 1

Cable end structures of aluminum stranded wires were formed in the same manner as in Example 1, except that the number of grooves of the serration or the ratio (d/e) between the groove depth d and the aluminum wire diameter e was set to a value outside the value range as specified in the above-mentioned item (1). The same tests and measurements as in Example 1 were then conducted. The results are shown in Table 1.

TABLE 1

| Classification | Sample No. | Material | Crimp contact: Barrel sheet thickness/length mm | Crimp contact: Serration: The number of grooves | Crimp contact: Serration: Groove depth d mm | Crimp contact: Serration: Groove width mm | Crimp contact: Stress relaxation ratio % | Aluminum stranded wire sectional area, The number of wires, Wire diameter e | Groove depth/elemental wire diameter d/e | Ratio between sectional areas before and after crimping p/q* | Pulling-out load kN | Electric resistance: Initial r mΩ | Electric resistance: Final s mΩ | Electric resistance: s/r | Total evaluation** |
|---|---|---|---|---|---|---|---|---|---|---|---|---|---|---|---|
| Example 1 | 1 | Bs-0 | 2.0/13 | 3 | 0.11 | 1 | 50 | 25 SQ 19 × 17 0.32 mm | 0.34 | 0.80 | 1.9 | 0.07 | 0.43 | 6.1 | ○○ |
| | 2 | | | 4 | 0.11 | 1 | 50 | | 0.34 | 0.80 | 2.1 | 0.06 | 0.40 | 6.7 | ○○ |
| | 3 | | | 5 | 0.11 | 1 | 50 | | 0.34 | 0.80 | 2.3 | 0.05 | 0.38 | 7.6 | ○○ |
| | 4 | | | 3 | 0.11 | 1 | 50 | | 0.34 | 0.70 | 1.8 | 0.06 | 0.40 | 6.7 | ○○ |
| | 5 | | | 3 | 0.11 | 1 | 50 | | 0.34 | 0.95 | 2.4 | 1.0 | 1.05 | 1.1 | ○○ |
| | 6 | | | 3 | 0.20 | 1 | 50 | | 0.63 | 0.80 | 2.0 | 0.05 | 0.33 | 6.6 | ○○ |
| | 7 | | | 3 | 0.30 | 1 | 50 | | 0.94 | 0.80 | 2.2 | 0.04 | 0.26 | 6.5 | ○○ |
| Example 2 | 8 | Bs-H | 2.3/13 | 3 | 0.11 | 1 | 65 | 25 SQ 19 × 17 0.32 mm | 0.34 | 0.80 | 2.0 | 0.8 | 0.90 | 1.1 | ○○ |
| Example 3 | 9 | C5210-H | 1.7/13 | 3 | 0.11 | 1 | 28 | 25 SQ 19 × 17 0.32 mm | 0.34 | 0.80 | 1.8 | 0.9 | 0.95 | 1.1 | ○○ |
| Example 4 | 10 | C1020-H | 2.0/13 | 3 | 0.11 | 1 | 73 | 25 SQ 19 × 17 0.32 mm | 0.34 | 0.80 | 2.2 | 0.8 | 1.45 | 1.8 | ○ |
| Example 5 | 11 | Bs-0 | 2.0/13 | 3 | 0.11 | 1 | 50 | 25 SQ 19 × 17 0.32 mm | 0.34 | 0.68 | 1.7 | 0.05 | 0.45 | 9.0 | ○ |
| | 12 | | | 3 | 0.11 | 1 | 50 | 25 SQ 19 × 17 0.32 mm | 0.34 | 0.96 | 1.7 | 1.0 | 1.50 | 1.5 | ○ |
| Comparative example 1 | 13 | Bs-0 | 2.0/13 | 2 | 0.11 | 1 | 50 | 25 SQ 19 × 17 0.32 mm | 0.34 | 0.80 | 1.5 | 1.1 | 1.7 | 1.5 | x |
| | 14 | | | 3 | 0.10 | 1 | 50 | 25 SQ 19 × 17 0.32 mm | 0.31 | 0.80 | 1.6 | 0.9 | 2.1 | 2.3 | x |

(Notes)
*"p": The sectional area of the aluminum stranded wire after the crimping thereof; "q": The sectional area of the aluminum stranded wire before the crimping thereof
**"○○": quite excellent; "○": excellent; "x": poor As is evident from Table 1, each of the cable end structures of the aluminum stranded wires in the examples according to the present invention (Samples No. 1 to No. 12), was high in pulling-out load, and low in electric resistance. In short, the structures were excellent in mechanical connectivity and electric connectivity. Quite excellent in the above-mentioned connectivities were, in particular, the samples satisfying that the stress relaxation ratio of the crimping portion was 70% or less and the ratio (p/q) between the sectional areas of the aluminum stranded wire before and after the crimping was from 0.7 to 0.95 (Samples No. 1 to No. 9).

Contrary to the above, in each of Sample No. 13 and Sample No. 14 of Comparative Example 1, the mechanical connectivity and electric connectivity were poor, since the number of grooves was small in the sample No. 13, and the ratio (d/e) between the groove depth and the aluminum wire diameter was small in the sample No. 14.

Example 6

Aluminum crimp contacts were formed from the same material in the same manner as in Example 1, except that alloy strips to which Sn plating was applied to give a thickness of 0.5 μm, 1.2 μm, 18 μm, and 24 μm, respectively, were used, and then cable end structures of aluminum stranded wire (samples No. 15 to No. 18) were formed in the same manner as in Example 1. The same tests and measurements as in Example 1 were then conducted. The number of grooves in the serration was set to 3, the groove depth was set to 0.11 mm, and the groove width was set to 1 mm, respectively. The ratio between the sectional areas before and after the crimping was set to 0.95. The Sn plating thickness was determined, by measuring the strength of fluorescent X-ray of 0.1 mm in collimator diameter at five points in the plating, and then averaging the measured values.

The thus-obtained results are shown in Table 2. For reference, those of sample No. 5 in the Example 1, in which the ratio between the sectional areas before and after the crimping was 0.95, are also shown in Table 2.

TABLE 2

| Sample No. | Sn plating | Thickness (μm) | Electric resistance (mΩ): Initial r | Electric resistance (mΩ): Final s | Electric resistance (mΩ): s/r |
|---|---|---|---|---|---|
| 15 | Applied | 0.5 | 1.0 | 1.1 | 1.1 |
| 16 | | 1.2 | 0.5 | 0.5 | 1.0 |
| 17 | | 18 | 0.5 | 0.5 | 1.0 |
| 18 | | 24 | 1.0 | 1.1 | 1.1 |
| 5 | Not applied | | 1.0 | 1.05 | 1.1 |

As is evident from Table 2, each of the cable end structures of aluminum stranded wires in which the Sn plating had a thickness in the range of 1.0 to 20 μm (inclusive) was low in electric resistance. The pulling-out strength in each of samples No. 15 to No. 18 was 2.4 kN, which was in the same level as that of the case to which no plating was applied (sample No. 5). In short, the examples according to the present invention were excellent in mechanical connectivity and electric connectivity.

Example 7

Cable end structures of aluminum stranded wires (samples No. 19 to No. 20) were formed in the same manner as in Example 1, except that the tensile strength (TS) and the Vickers hardness (Hv) of the crimp contact were variously changed. The same tests and measurements as in Example 1 were then conducted. The number of grooves in the serration was set to 3, the groove depth was set to 0.11 mm, and the groove width was set to 1 mm, respectively. The ratio between the sectional areas before and after the crimping was set to 0.95.

As for the tensile strength of the crimp contacts, test pieces prescribed in JIS Z2201 were prepared from the strips before the strips were pressed, and the tensile strength was tested in accordance with a test method prescribed in JIS Z2241. The Vickers hardness test was conducted in accordance with JIS Z2244.

The thus-obtained results are shown in Table 3.

TABLE 3

| Sample No. | Contact TS (MPa) | Contact Hv ($N/mm^2$) | Aluminum wire TS (MPa) | Aluminum wire Hv ($N/mm^2$) | Ratio of strength and hardness TS ratio | Ratio of strength and hardness Hv ratio | Electric resistance (mΩ) Initial r | Electric resistance (mΩ) Final s | Electric resistance (mΩ) s/r |
|---|---|---|---|---|---|---|---|---|---|
| 19 | 380 | 85 | 200 | 45 | 1.9 | 1.9 | 1.0 | 1.05 | 1.1 |
| 20 | 400 | 100 | | | 2.0 | 2.2 | 0.7 | 0.7 | 1.0 |

As is evident from Table 3, each of the samples (Nos. 19 and 20) satisfied the preferable regulations of electric resistance. In particular, in the case where the tensile strength of the contact material was 400 MPa or more, the Vickers hardness was 90 or more, and the ratio between the tensile strengths and the ratio between the Vickers hardnesses (the ratio (that of the contact)/(the aluminum wires)) were each 2 or more, the cable end structure of the aluminum stranded wire was low in electric resistance and was also stable after the deterioration test. The pulling-out strength was 2.4 kN in each of samples No. 19 and No. 20.

Example 8

Cable end structures of aluminum stranded wires (samples No. 21 to No. 23) were formed in the same manner as in Example 1, except that the thickness of the oxide film of the aluminum wires constituting the aluminum stranded wire to be crimped was set to 5 nm, 20 nm, and 25 nm, respectively. The same tests and measurements as in Example 1 were then conducted. The number of grooves in the serration was set to 3, the groove depth was set to 0.11 mm, and the groove width was set to 1 mm, respectively. The ratio between the sectional areas before and after the crimping was set to 0.95. The thickness of the oxide film was controlled by heating of the aluminum stranded wire in the atmosphere.

About the oxide film on the surface of the aluminum stranded wire, a region 10-μm square therein was measured by the Auger electron spectrometry. The aluminum wires were continuously chiseled from their surfaces by an argon ion gun capable of sputtering $SiO_2$ having a thickness of 100 nm for 10 minutes, and were subjected to spectrometry at each interval. From the sputtering period of time required to chisel until the percent by mass of oxygen turned to a half of that in the outermost surface, the thickness of the oxide film was determined by calculation, using the sputtering rate (4 nm/minute) of $Al_2O_3$.

The thus-obtained results are shown in Table 4.

TABLE 4

| Sample No. | Thickness of oxide film (nm) | Electric resistance (mΩ) Initial r | Electric resistance (mΩ) Final s | Electric resistance (mΩ) s/r |
|---|---|---|---|---|
| 21 | 5 | 0.8 | 1.0 | 1.3 |
| 22 | 20 | 0.8 | 1.0 | 1.3 |
| 23 | 25 | 1.0 | 1.5 | 1.5 |

As is evident from Table 4, the samples (No. 21 to No. 22) each satisfied the preferable regulations of electric resistance. When the oxide film of the aluminum wires was 20 nm or less in thickness, the cable end structures of aluminum stranded wires were low in electric resistance and were also stable after the deterioration test. The pulling-out strength was 2.4 kN in each of the samples (No. 21 to No. 22).

INDUSTRIAL APPLICABILITY

The crimp contact for an aluminum stranded wire, of the present invention, is excellent in electric connectivity and mechanical connectivity, and can favorably be used, for example, as a crimp contact for electric connection of automobile wire harnesses, battery cables, or the like, using an aluminum stranded wire.

Having described our invention as related to the present embodiments, it is our intention that the invention not be limited by any of the details of the description, unless otherwise specified, but rather be construed broadly within its spirit and scope as set out in the accompanying claims.

The invention claimed is:

1. A crimp contact for an aluminum stranded wire having a serration provided in an inner face of a crimping portion of the crimp contact, wherein a ratio d/e is 0.33 or more, in which d represents a depth of a groove constituting the serration and e represents a diameter of an aluminum wire constituting the aluminum stranded wire, and wherein the number of grooves is 3 or more.

2. The crimp contact for an aluminum stranded wire according to claim 1, wherein the crimping portion is composed of copper or a copper alloy, and wherein a stress relaxation ratio of the crimping portion is 70% or less.

3. A cable end structure of an aluminum stranded wire to which the crimp contact for an aluminum stranded wire according to claim 1 is crimped, wherein a ratio p/q is from 0.7 to 0.95, in which p represents a sectional area of the aluminum stranded wire after crimping and q represents a sectional area of the aluminum stranded wire before crimping.

* * * * *

UNITED STATES PATENT AND TRADEMARK OFFICE

CERTIFICATE OF CORRECTION

PATENT NO. : 7,544,892 B2
APPLICATION NO. : 12/153862
DATED : June 9, 2009
INVENTOR(S) : Kyota Susai et al.

It is certified that error appears in the above-identified patent and that said Letters Patent is hereby corrected as shown below:

On the Title Page:

Please insert the following as item (63):

-- (63) Related U.S. Application Data

Continuation of application No. PCT/JP2006/323232, filed on Nov. 21, 2006. --.

Please insert the following as item (30):

-- (30) Foreign Application Priority Data

Nov. 24, 2005 (JP) ..... 2005-338604
Oct. 27, 2006 (JP) ..... 2006-293215 --.

Signed and Sealed this

Twelfth Day of October, 2010

David J. Kappos

David J. Kappos
*Director of the United States Patent and Trademark Office*